US008039523B2

(12) United States Patent
Yamada et al.

(10) Patent No.: US 8,039,523 B2
(45) Date of Patent: Oct. 18, 2011

(54) RESIN COMPOSITION FOR PRESS FOAMING, FOAM AND PROCESS FOR PRODUCING THE FOAM

(75) Inventors: Katsuhiro Yamada, Chiba (JP); Tatsuhiro Nagamatsu, Chiba (JP)

(73) Assignee: Sumitomo Chemical Company, Limited, Tokyo (JP)

( * ) Notice: Subject to any disclaimer, the term of this patent is extended or adjusted under 35 U.S.C. 154(b) by 470 days.

(21) Appl. No.: 11/902,566

(22) Filed: Sep. 24, 2007

(65) Prior Publication Data

US 2008/0081845 A1 Apr. 3, 2008

(30) Foreign Application Priority Data

Sep. 29, 2006 (JP) ..... 2006-267182

(51) Int. Cl.
*C08J 9/00* (2006.01)
*B29C 44/34* (2006.01)
*C08F 210/02* (2006.01)

(52) U.S. Cl. ..... 521/134; 521/142; 526/348; 526/160

(58) Field of Classification Search ..... 521/142, 521/134; 526/348, 160
See application file for complete search history.

(56) References Cited

U.S. PATENT DOCUMENTS

2004/0261297 A1* 12/2004 Park ..... 36/87
2007/0100106 A1 5/2007 Iseki et al.

FOREIGN PATENT DOCUMENTS

JP 3-2657 B 1/1991
JP B-302657 1/1991
JP 2005-314638 * 11/2005
JP 2005-314638 A 11/2005
JP A-2005-314638 11/2005

* cited by examiner

*Primary Examiner* — Randy Gulakowski
*Assistant Examiner* — Kara Negrelli
(74) *Attorney, Agent, or Firm* — Fitch, Even, Tabin & Flannery

(57) ABSTRACT

A resin composition for pressure-foam molding, which comprises an ethylene-based copolymer and a foaming agent, wherein the ethylene-based copolymer has monomer units derived from ethylene and monomer units derived from an a-olefin having 3 to 20 carbon atoms, has a melt flow rate of 0.01 to 0.7 g/10 minutes, a molecular weight distribution of 5 or more determined by a gel permeation chromatography, an activation energy of flow of 40 kJ/mol or more, and inflection points of 3 or less on a melting curve within temperature range from 25° C. to the end point of melting obtained by a differential scanning calorimetry; a foam obtained by press foaming; and a process for producing the foam.

9 Claims, No Drawings

RESIN COMPOSITION FOR PRESS FOAMING, FOAM AND PROCESS FOR PRODUCING THE FOAM

This U. S. Application claims the benefit and foreign priority from Japanese Patent Application No. 2006-27182 filed Sep. 29, 2006, the complete disclosures of which are incorporated herein by reference.

BACKGROUND OF THE INVENTION

1. Field of the Invention

The invention relates to a resin composition for press foaming, a foam obtained by press foaming, a process for producing a foam through press foaming, a footwear member having a layer of the foam and a footwear having the footwear member.

2. Description of the Prior Art

Foamed molded bodies obtained by press foaming are widely used for convenience goods, flouring materials, sound insulating materials, heat insulating materials, foot wears (e.g. outer soles, mid soles, insoles), and the like. As the foam, a foam obtained by subjecting an ethylene-vinyl acetate copolymer to press foaming is disclosed in JP-B-3-2657. Further, there is disclosed in JP-A-2005-314638, a molded body obtained by subjecting an ethylene-α-olefin copolymer obtained by copolymerizing ethylene with an α-olefin with a polymerization catalyst prepared by contact-treating a contact-treated product triisobutylaluminum with racemi-ethylene-bis(1-indenyl)zirconium diphenoxide, with a co-catalyst support obtained by reacting diethyl zinc, pentafluorophenol, water, silica and hexamethyldisilazane, to pressure foam molding. However, though the foam of the ethylene-vinyl acetate copolymer described above was good in fatigue-resistance, it was insufficiently satisfied in tensile strength at break, and further, though the above-described foam of the ethylene-α-olefin copolymer was good in tensile strength at break, the fatigue-resistance was not sufficiently satisfied. Therefore, the foamed molded bodies were not sufficiently satisfied in balance between fatigue-resistance and tensile strength at break.

SUMMARY OF THE INVENTION

Under such situations, objects of the present invention are to provide a resin composition for press foaming giving a foam excellent in balance between fatigue resistance and tensile strength at break, a process for producing a foam through a press foaming, a foot wear member having the foam and a foot wear having the foot wear member.

Namely, a first aspect of the present invention is a resin composition for a pressure-foam molding, which comprises an ethylene-based copolymer and foaming agent, wherein the ethylene-based copolymer has monomer units derived from ethylene and monomer units derived from an a-olefin having 3 to 20 carbon atoms, has a melt flow rate of 0.01 to 0.7 g/10 minutes, a molecular weight distribution (Mw/Mn) of 5 or more determined by a gel permeation chromatography, an activation energy of flow (Ea) of 40 kJ/mol or more, and the number of inflection points of 3 or less on a melting curve within temperature range from 25° C. to an end point of melting obtained by a differential scanning calorimetry.

Further, a second aspect of the present invention relates to a foam produced by press foaming the above-described resin composition.

Still further, a third aspect of the present invention relates to a process for producing a foam, which comprises subjecting the above-described resin composition to press foaming.

Still further, a fourth aspect of the present invention relates to a footwear member comprising a layer containing the foam.

Still further, a fourth aspect of the present invention relates to a footwear comprising the footwear member.

According to the present invention, there can be provided a resin composition for press foaming giving a foam excellent in balance between fatigue resistance and tensile strength at break, a foam obtained by press foaming, a process for producing a molded body through press foaming, a footwear member and a footwear.

DETAILED DESCRIPTION OF THE INVENTION

The ethylene-based copolymer used in the present invention is an ethylene-based copolymer having monomer units derived from ethylene and monomer units derived from an a-olefin having 3 to 20 carbon atoms. Examples of the a-olefin include propylene, 1-butene, 4-methyl-1-pentene, 1-hexene, 1-octene and 1-decene, and preferably 1-butene and 1-hexene.

Examples of the ethylene-based copolymer used in the present invention includes, for example, ethylene-1-butene copolymers, ethylene-4-methyl-1-pentene copolymers, ethylene-1-hexene copolymers, ethylene-1-octene copolymers, ethylene-1-decene copolymers, ethylene-1-butene-4-methyl-1-pentene copolymers, ethylene-1-butene-1-hexene copolymers and ethylene-1-butene-1-octene copolymers; from the viewpoint of tensile strength at break, preferably ethylene-1-butene copolymers, ethylene-1-hexene copolymers, ethylene-1-butene-1-hexene copolymers, and more preferably, ethylene-1-butene-1-hexene copolymers and ethylene-1-hexene copolymers.

The ethylene-based copolymer used in the present invention preferably has monomer units based on the ethylene of 50% by weight or more to the all monomer units of the copolymer (100% by weight).

The melt flow rate (MFR; unit is g/10 minutes) of the ethylene-based copolymer is 0.01 to 0.7 g/10 minutes, preferably 0.05 g/10 minutes or more, more preferably 0.1 g/10 minutes or more. When the melt flow rate is less than 0.01 g/10 minutes, the expansion ratio reduces and foam moldability deteriorates. On the other hand, the MFR of the ethylene-based copolymer is 0.7 g/10 minutes or less, preferably 0.6 g/10 minutes or less, more preferably 0.5 g/10 minutes or less. When the melt flow rate is more than 0.7 g/10 minutes, the tensile strength at break of the foam lowers and a fatigue-resistance deteriorates. The MFR is determined with the A-method coded in JIS K7210-1995 under conditions of a temperature of 190° C. and a load of 21.18 N. In the MFR measurement, usually used is an ethylene-a-olefin copolymer blended in advance with about 1000 ppm of an antioxidant.

The density (d; unit is $kg/m^3$) of the ethylene-a-olefin copolymer is usually 870 to 930 $kg/m^3$. From the viewpoint of keeping a rigidity of the foam, it is preferably 870 $kg/m^3$ or more, more preferably 890 $kg/m^3$ or more, and further more preferably 900 $kg/m^3$ or more. Further, from the viewpoint of heightening the softness of the foam, it is 930 $kg/m^3$ or less, and more preferably 925 $kg/m^3$ or less. The density is measured according to a water-substitution method described in JIS K7112-1980 after annealed according to JIS K6760-1995.

The activation energy (Ea) of flow of the ethylene-based copolymer is 40 kJ/mol or more. The Ea of conventional ethylene-based copolymers are usually less than 40 kJ/mol, and the foamed molded bodies obtained by press foaming of the copolymers may become nonuniform in foam properties leading to inferior in appearance. From the viewpoints of heightening foam properties, the Ea is preferably 50 kJ/mol or more, more preferably 55 kJ/mol or more. Further, from the viewpoints of smoothing of the surface of the foamed molded bodies obtained by press foaming, the Ea is preferably 100 kJ/mol or less, more preferably 90 kJ/mol or less.

The activation energy of flow (Ea) is a value calculated according to the Arrhenius equation with a shift factor ($a_T$), the shift factor ($a_T$) being defined while preparing a master curve of melt complex viscosity (unit is Pa·sec) at 190° C. depending on angular frequency (unit is rad/sec) according to the time-temperature superposition principle, and the value of Ea is determined by the following procedure:

Preparing melt complex viscosity-angular frequency curves (melt complex viscosity is expressed in Pa·sec, angular frequency is expressed in rad/sec) of an ethylene-a-olefin copolymer at temperatures (T, expressed in ° C.) of 130° C., 150° C., 170° C., and 190° C. respectively, shifting the melting complex viscosity-angular frequency curves obtained at respective temperatures (T) to respectively superpose on the melt complex viscosity-angular frequency curve of the ethylene-based copolymer at 190° C. according to the time-temperature superposition principle, thus obtaining the shift factors ($a_T$) at the respective temperatures which represent an extent of shifting each curve for the above superposition, calculating a value of [ln($a_T$)] with the shift factors ($a_T$) at the respective temperatures and that of [1/(T+273.16)] with the respective temperatures; and then determining a linear approximation equation (the formula (I) represented below) correlating the above calculated values according to the least-squares method; thereafter, Ea is determined by combining a value of slope m of the linear approximation equation and the formula (II) represented below:

$$\ln(a_T)=m(1/(T+273.16))+n \quad \text{(I)},$$

$$Ea=|0.008314\times m| \quad \text{(II)},$$

$a_T$: Shift factor,

Ea: Activation energy of flow (unit; kJ/mol),

T: Temperature (unit; ° C.).

The above calculation may be carried out with using a commercially available calculation software, which includes Rhios V.4.4.4 manufactured by Rheometrics.

The shift factor ($a_T$) represents the extent of shifting each of the melting complex viscosity-angular frequency curves obtained at respective temperatures, wherein each of the curves plotted on a double logarithmic chart is shifted in the direction of log(Y)=−log(X) (wherein y-axis represents melt complex viscosity and x-axis represents angular frequency) to superpose on the melting complex viscosity-angular frequency curve at 190° C., and each of the double logarithmic melt complex viscosity-angular frequency curves is superposed by shifting in amounts of $a_T$ times angular frequency and $1/a_T$ times melting complex viscosity. For determining the formula (I) depending on the values obtained at 130° C., 150° C., 170° C., and 190° C. according to the least-squares method, a value of 0.99 or more is usually employed as a correlation coefficient.

The melt complex viscosity-angular frequency curve is measured with a viscoelasticity meter (for example, Rheometrics Mechanical Spectrometer RMS-800, manufactured by Rheometrics, and the like) usually under the conditions of a geometry with parallel plate, a plate diameter with 25 mm, a plate clearance with 1.5 to 2 mm, a strain with 5%, and an angular frequency with 0.1 to 100 rad/sec. The measurement is carried out under a nitrogen atmosphere, and a sample for measurement may be blended in advance with an appropriate amount of antioxidant (for example, 1000 ppm).

The molecular weight distribution (Mw/Mn) of the ethylene-based copolymer, in view of heightening foam properties, and in view of heightening the expansion ratio, is preferably 5 or more, more preferably 5.5 or more, and even more preferably 6 or more.

On the other hand, the molecular weight distribution (Mw/Mn) is 20 or less, and more preferably 15 or less. The molecular weight distribution (Mw/Mn) is a value of Mw divided by Mn, wherein the weight average molecular weight (Mw) and the number average molecular weight (Mn) are measured by a gel permeation chromatography (GPC). Conditions for GPC measurement are exemplified as follows:

(1) Apparatus: Waters 150C manufactured by Water, Inc.
(2) Separation column: TOSOH TSKgelGMH6-HT
(3) Measurement temperature: 140° C.
(4) Carrier: ortho-dichlorobenzene
(5) Flow rate: 1.0 mL/minute
(6) Injected volume: 500 μL
(7) Detector: Differential refractometer
(8) Standard substance for molecular weight: Standard polystyrene The ethylene-based copolymer used in the present invention is a polymer having the number of inflection points of 3 or less on a melting curve obtained by a differential scanning calorimetry within a temperature range from 25° C. to an end point of melting. If the number of inflection points is large, this means that there exist a number of other melting peaks or shoulder peaks other than the maximum melting peak (a melting peak having the highest peak height) on the melting curve of the ethylene-a-olefin copolymer, thus means that there exist a number of polymer components having a different content of the monomer unit in the ethylene-a-olefin copolymer and the composition distribution of the ethylene-a-olefin copolymer (i.e. distribution of monomer unit contents in polymer components contained in the ethylene-a-olefin copolymer) is broad. On the other hand, if the number of inflection points is small, this means that the composition distribution of the ethylene-a-olefin copolymer is narrow. Herein, the inflection point refers to a transition point of the melting curve changing from being concaved to convexed or from being convexed to concaved.

The ethylene-based copolymer used in the present invention is a copolymer satisfying the following formula (1) wherein a density of the ethylene-a-olefin copolymer is d (kg/m$^3$) and a maximum melting point (a temperature at a peak of endothermic heat flow profile having the highest peak height (maximum melting peak) in the melting curve) is Tm (° C.):

$$0.675\times d-514.8\leqq Tm\leqq 0.775\times d-601 \quad (1).$$

In an ethylene-a-olefin copolymer having a narrow composition distribution, properties of a major polymer component of the copolymer are dominant in that of the copolymer. Therefore, a melting point of the major polymer component of the copolymer becomes near to that of an ethylene-based copolymer consisted of a single component (consisted only of a polymer component of which monomer unit content is same as the monomer unit content of the whole copolymer (average monomer unit content)). It is known that an average monomer unit content of the ethylene-a-olefin copolymer correlates with a density. To say other words, the formula (1) mentioned above is an index to represent a narrowness of the composition distribution.

The ethylene-based copolymer of the invention, in view of enhancing fatigue resistance, preferably has narrow composition distribution and lower the rate of high melting point components, that is, the maximum melting point (Tm) of the ethylene-based copolymer preferably satisfies the formula (1'), more preferably satisfying the formula (1"):

$$0.675\times d-514.6\leqq Tm\leqq 0.775\times d-602.5 \quad (1')$$

$$0.675\times d-514.4\leqq Tm\leqq 0.775\times d-604.0 \quad (1'')$$

The melting curve of the ethylene-based copolymer can be derived from a differential scanning calorimetry curve measured with a differential scanning calorimeter (for example, the differential scanning calorimeter DSC-7 type manufactured by Perkin Elmer Co., Ltd.) according to a procedure such that about 10 mg of sample enclosed in a pan made of aluminum is (1) preserved at 150° C. for 5 minutes, (2) cooled down from 150° C. to 20° C. at a rate of 5° C./minute, (3) again preserved at 20° C. for 2 minutes, (4) further heated up from 20° C. to a temperature of an end point of melting plus about 20° C. (usually about 150° C.) to obtain the curve from the step (4).

A method for producing the ethylene-a-olefin copolymer of the invention includes copolymerizing ethylene and a-olefin in the presence of a catalyst which is formed by contacting metallocene-based complex (a transitional metal complex having a cyclopentadienyl-type anion skeleton), a fine particle-like support, and a compound forming an ionic complex by ionizing the metallocene complex. In the production method, preferable is a method of copolymerizing ethylene and a-olefin with using a solid catalyst component carrying a catalyst component on a fine particle-like support, and the solid catalyst component, for example, may use a co-catalyst support which carries a compound forming an ionic complex by ionizing the metallocene complex (for example, organic aluminum oxy compounds, boron compounds, and organic zinc compounds) on a fine particle-like support.

The fine particle-like support is preferably a porous material, and may use inorganic oxides such as $SiO_2$, $Al_2O_3$, MgO, $ZrO_2$, $TiO_2$, $B_2O_3$, CaO, ZnO, BaO, and $ThO_2$; clays and clay minerals such as smectite, montmorillonite, hectolite, laponite, and saponite; and organic polymers such as polyethylene, polypropylene, and styrene-divynilbenzene copolymer. A 50% volume average particle diameter of the fine particle-like support is usually 10 to 500 μm, and the 50% volume average particle diameter is determined with a laser diffracted light scattering system and the like. Pore volumes of the fine particle-like support are usually 0.3 to 10 ml/g, and the pore volumes are usually measured with a gas adsorption method (BJH method). A specific surface area of the fine particle-like support is usually 10 to 1000 $m^2/g$, the specific surface area is usually measured with a gas adsorption method (BET method).

As a method for producing the ethylene-a-olefin copolymer of the invention, particularly suitably included is copolymerizing ethylene and a-olefin in the presence of a catalyst which is formed by contacting the co-catalyst support (A) mentioned below, metallocene-based complex (B) with a structure in which two cyclopentadienyl anion skeletons is connected through a bridging group such as alkylene group or silylene group, and an organoaluminum compound (C).

The co-catalyst support (A) mentioned above is a support obtained by contacting a component (a); diethyl zinc, a component (b); two kinds of fluorized phenoles, a component (c); water, a component (d); inorganic fine particle-like support, and a component (e); trimethyldisilazane ($((CH_3)_3Si)_2NH$).

The fluorinated phenole of the component (b) includes pentafluorophenol, 3,5-difluorophenol, 3,4,5-trifluorophenol, 2,4,6-trifluorophenol, and the like. From the viewpoint of enhancing the activation energy of flow (Ea) of the ethylene-a-olefin copolymer, it is preferable to use two kinds of fluorinated phenoles respectively having the different number of fluorine atoms; for example, included are combinations of pentafluorophenol/3,4,5-trifluorophenol, pentafluorophenol/2,4,6-trifluorophenol, and pentafluorophenol/3,5-difluorophenol, preferably a combination of pentafluorophenol/3,4,5-trifluorophenol. A molar ratio between a fluorinated phenole with the larger number of fluorine atoms and that with the smaller number of fluorine atoms is usually 20/80 to 80/20. From the viewpoint of enhancing heat shrinkability, preferable is a smaller molar ratio such as 50/50 or less, and more preferably 40/60 or less.

The inorganic fine particle-like support of the component (d) is preferably a silica gel.

There is no particular limitation regarding to amounts using the component (a), the component (b) and the component (c), and they are preferably used in a manner that, if a molar ratio between them is defined as the component (a): the component (b): the component (c)=1:x:y, the x and y satisfy the following equation:

$$|2-x-2y|\leqq 1.$$

A value of x in the above equation is preferably 0.01 to 1.99, more preferably 0.10 to 1.80, even more preferably 0.20 to 1.50, and most preferably 0.30 to 1.00.

The component (d) is used to the component (a) in an amount such that, when a particle is formed by contacting the component (a) with the component (d), the mole number of zinc atoms derived from the component (a) contained in 1 g of the particle is preferably 0.1 mmol or more, and more preferably 0.5 to 20 mmol. The component (e) is generally used in an amount of 0.1 mmol or more per 1 g of the component (d), and more preferably 0.5 to 20 mmol.

A metal atom of the metallocene complex (B) which has a ligand having a structure in which two cyclopentadienyl type anion skeletons are connected through a bridging group such as an alkylene group or silylene group, includes preferably atoms belonging to the group 4 of the Periodic Table of the Elements, and more preferably zirconium and hafnium. The ligand includes preferably an indenyl group, methylindenyl group, methylcyclopentadienyl group and dimethylcyclopentadienyl group; and the bridging group includes preferably an ethylene group, dimethylmethylene group and dimethylsilylene group. The rest of substituents owned by the metal atom includes preferably a diphenoxy group and dialkoxy group. The metallocene-based complex (B) includes preferably ethylenebis(1-indenyl)zirconium diphenoxide.

The organoaluminum compound (C) includes preferably triisobutylaluminum and tri-n-octylaluminum.

The metallocene complex (B) is preferably used in an amount of $5\times10^{-6}$ to $5\times10^{-4}$ mol per 1 g of the co-catalyst support (A). The organoaluminum compound (C) is preferably used in an amount of 1 to 2000 in terms of a molar ratio (Al/M) of the aluminum atom of the organoaluminum compound (C) to the metal atom of the metallocene-based complex (B).

In the catalyst for polymerization which is prepared by contacting the above mentioned co-catalyst support (A), metallocene complex (B), and an organoaluminum compound (C), the catalyst may be prepared, depending on requirements, by contacting an electron donating compound (D) to the co-catalyst support (A), metallocene-based complex (B), and an organic aluminum compound (C). The electron donating compound includes preferably triethylamine and tri-n-octylamine.

In view of enlarging a molecular weight distribution of the ethylene-a-olefin copolymer to be obtained, the electron donating compound (D) is preferably used, which is used preferably 0.1% by mole or more to the mole number of aluminum atoms of the organic aluminum compound (C), and more preferably 1% by mole or more; and in view of enhancing catalyst activity, being preferably 10% by mole or less, and more preferably 5% by mole or less.

As a method for producing the ethylene-a-olefin copolymer of the present invention, ethylene and an a-olefin are preferably copolymerized with a prepolymerization solid component as a catalyst component or catalyst, the prepolymerization solid component being prepared by polymerizing a small amount of an olefin (hereinafter, may be referred to as "prepolymerization") with using a solid catalyst component carrying a catalyst component on a fine particle-like support, for example, a prepolymerization solid component prepared by polymerizing a small amount of olefin with using a co-catalyst support, metallocene-based complex, and other co-catalyst component (e.g. alkylating agents including organoaluminum compounds).

The olefin used in the prepolymerization includes ethylene, propylene, 1-butene, 1-pentene, 1-hexene, 1-octene, 4-methyl-1-pentene, cyclopentene, and cyclohexene. They may be used independently or as a combination of two or more kinds thereof. An amount of the polymer contained in the prepolymerization solid component is usually 0.1 to 500 g per 1 g of solid catalyst component, preferably 1 to 200 g.

A method for prepolymerization may be continuous- or batch-polymerizations, for example, including batch-system slurry polymerizations, continuous-system slurry polymerizations, and continuous-system gas phase polymerizations. Catalyst components such as a co-catalyst support, metallocene complex, and other co-catalyst component (e.g. alkylating agents such as organoaluminum compounds) are usually charged into a polymerization reactor with a way of putting them with using an inert gas such as nitrogen or argon, hydrogen, ethylene and the like under a water free condition, or a way of putting a solution or slurry which dissolves or dilutes them with a solvent.

In the prepolymerization, from the viewpoint of enhancing a fatigue resistance through narrowing a composition distribution of the ethylene-a-olefin copolymer to be obtained, the catalyst components are preferably input into a polymerization reactor in a manner such that a co-catalyst support and a metallocene-based complex are contacted to form a pre-contacted substance, and then the pre-contacted substance obtained is further contacted with the other co-catalyst component to form a contacted substance which will be a prepolymerization catalyst, this manner is exemplified as follows: (1) a method of putting the co-catalyst support and metallocene-based complex into a polymerization reactor, followed by putting the other co-catalyst component therein; (2) a method of contacting in advance the co-catalyst support and metallocene-based complex to obtain a pre-contacted substance, putting the pre-contacted substance obtained into a polymerization reactor, and then putting the other co-catalyst component therein; (3) a method of contacting in advance the co-catalyst support and metallocene-based complex to obtain a pre-contacted substance, putting the pre-contacted substance obtained into a polymerization reactor in which the other co-catalyst component has been already input; and (4) a method of preparing in advance a contacted substance consisting of the co-catalyst support, metallocene-based complex, and the other co-catalyst component by contacting the co-catalyst support and metallocene-based complex to obtain a pre-contacted substance, followed by contacting the pre-contacted substance obtained with the other co-catalyst component, and then putting the contacted substance obtained into a polymerization reactor. Further, A prepolymerization temperature is usually lower than the melting point of the polymer prepolymerized, preferably 0 to 100° C., more preferably 10 to 70° C.

When the prepolymerization is conducted by a slurry polymerization, a solvent used includes hydrocarbons having carbon atoms of 20 or less; for example, including saturated aliphatic hydrocarbon such as propane, n-butane, isobutane, n-pentane, isopentane, n-hexane, cyclohexane, heptane, octane, and decane; and aromatic hydrocarbons such as benzene, toluene, and xylene. They may be used alone or in a combination of two or more kinds thereof.

The ethylene-a-olefin copolymer is preferably produced with a continuous polymerization method which accompanies formation of particles of ethylene-a-olefin copolymer; for example including continuous gas-phase polymerization methods, continuous slurry polymerization methods, and continuous bulk polymerization methods, more preferably the continuous gas-phase polymerization methods. The continuous gas-phase polymerization apparatus used for the methods is usually an apparatus with a fluidized bed reactor, and preferably an apparatus with a fluidized bed reactor having an enlarged member. An agitation blade paddle may be mounted in the reactor vessel.

A method for supplying the prepolymerization solid component prepolymerized into a continuous polymerization reactor which accompanies formation of particles of ethylene-a-olefin copolymer usually includes a way of supplying it with using an inert gas such as nitrogen or argon, hydrogen, ethylene and the like under a water free condition, or a way of supplying a solution or slurry which dissolves or dilutes it with a solvent.

A temperature for polymerization accompanying formation of ethylene-a-olefin copolymer particles is usually less than a melting point of the ethylene-a-olefin copolymer, preferably 0 to 150° C., and more preferably 30 to 100° C.; in view of enhancing gloss of moldings, preferably less than 90° C., and specifically 70 to 87° C. Hydrogen may be added as a molecular weight modifier to control a melt fluidity of the ethylene-a-olefin copolymer. And, an inert gas may be coexisted in the mixed gas. When the prepolymerization solid component is used, a co-catalyst component such as an organoaluminum compound may be appropriately used.

Furthermore, in the production of the ethylene-α-olefin copolymer of the present invention, it is preferable that the process contains a step of kneading (1) an ethylene-α-olefin copolymer obtained by polymerization with an extruder having an extended flow kneading die, for example, a die developed by Utracki et al and disclosed in U.S. Pat. No. 5,451,106, or (2) an extruder equipped with counter-rotating twin screws having a gear pump, and preferably with a retention part between the screw and die, or the like.

The resin composition for press foaming of the present invention may includes an ethylene-unsaturated ester-based copolymer (B) having monomer units based on ethylene and monomer units based on at least one unsaturated ester selected from the group consisting of carboxylic acid vinyl esters and ethylenically unsaturated carboxylic acid alkyl esters in addition to the before-described ethylene-based copolymer (herein-after, referred to as ethylene-based copolymer (A)).

A foam obtained by press foaming of a resin composition containing the ethylene-based copolymer (A), the ethylene-unsaturated ester-based copolymer (B) and a foaming agent, imparts an excellent adhesiveness in lamination with another layer. Example of the carboxylic acid vinyl esters include vinyl acetate and vinyl propionate, and examples of the ethylenically unsaturated carboxylic acid alkyl esters include methyl acrylate, ethyl acrylate, n-propyl acrylate, isopropyl acrylate, n-butyl acrylate, t-butyl acrylate, isobutyl acrylate, methyl methacrylate, ethyl methacrylate, n-propyl methacrylate, isopropyl methacrylate, n-butyl methacrylate, t-butyl methacrylate and isobutyl methacrylate.

The ethylene-unsaturated ester-based copolymer (B) is preferably ethylene-vinyl acetate copolymer, ethylene-methyl methacrylate copolymer, ethylene-methyl acrylate copolymer or ethylene-ethyl acrylate copolymer.

The melt flow rate (MFR) of the ethylene-unsaturated ester-based copolymer is usually 0.1 to 1000 g/10 minutes. The MFR is measured by A-method at 190° C. under a load of 21.18 N according to JIS K7210-1995.

In the ethylene-unsaturated ester-based copolymer (B), the content of monomer units based on the carboxylic acid vinyl esters and/or ethylenically unsaturated carboxylic acid alkyl esters, is usually 2 to 50% by weight based on 100% by weight of the total monomer units of the ethylene-unsaturated ester-based copolymer (B), and the content is measured by a known method. For example, the content of monomer units based on the vinyl acetate is measure according to JIS K6730-1995.

The ethylene-unsaturated ester-based copolymer (B) can be obtained by a known polymerization method using a known polymerization catalyst (initiator). For example, a bulk polymerization and solution polymerization methods using a radical initiator and the like can be listed.

When the resin composition for press foaming contains the ethylene-α-olefin based copolymer (A) and the ethylene-unsaturated ester-based copolymer (B), contents of the (A) and (B) are respectively preferably 99 to 30% by weight and 1 to 70% by weight based on 100% by weight of the total of (A) and (B). When the content of the ethylene-α-olefin based copolymer (A) is less than 30% by weight, a balance between the tensile strength at break and the density of the foam obtained by press foaming, may become bad.

The contents of the (A) and (B) are respectively preferably 40% by weight or more and 60% by weight or less, more preferably 50% by weight or more and 50% by weight or less.

On the other hand, when the content of the ethylene-α-olefin based copolymer (A) is more than 99% by weight, adhesiveness inter layers in lamination of the foam obtained by the press foaming with another layer, may deteriorate. The contents of the (A) and (B) are respectively preferably 98% by weight or less and 2% by weight or more, more preferably 95% by weight or less and 5% by weight or more, further more preferably 90% by weight or less and 10% by weight or more.

As the foaming agent used in the present invention, thermal decomposition type foaming agents having a decomposition temperature not lower than the melt temperature of the copolymer are mentioned. For example, there are mentioned azodicarbonamide, barium azodicarboxylate, azobisbutyronitrile, nitrodiguanidine, N,N-dinitrosopentamethylenetetramine, N,N'-dimethyl-N,N'-dinitrosoterephthalamide, P-toluenesulfonyl hydrazide, P,P'-oxybis(benzenesulfonyl hydrazide)azobisisobutyronitrile, P,P'-oxybisbenzenesulfonyl semicarbazide, 5-phenyltetrazole, trihydrazinotriazine, hidrazodicarbonamide and the like, and these are used singly or in combination of two or more.

Among them, azodicarbonamide or sodium hydrogen carbonate is preferable.

The compounding ratio of the foaming agent is usually 1 to 50 parts by weight, preferably 1 to 15 parts by weight per 100 parts by weight of the ethylene-based copolymer.

In the above-mentioned resin composition of the present invention, a foaming auxiliary may be compounded, if necessary. The foaming auxiliary includes compounds containing urea as the main component; metal oxides such as zinc oxide and lead oxide; higher fatty acids such as salicylic acid and stearic acid; metal compounds of the higher fatty acids, and the like. The use amount of the foaming auxiliary is preferably 0.1 to 30 wt %, more preferably 1 to 20% by weight based on the total amount of the foaming agent and foaming auxiliary of 100% by weight.

In the above-mentioned composition obtained by melt mixing, a cross-linking agent may be compounded if necessary, and the composition containing the compounded cross-linking agent may be cross-linked and foamed with heating to give a cross-linked pressure-foamed molding. As the cross-linking agent, organic peroxides having a decomposition temperature not lower than the flow initiation temperature of the copolymer are suitably used, and examples thereof include dicumyl peroxide, 1,1-di-tertiary butyl peroxy-3,3,5-trimethylcyclohexane, 2,5-dimethyl-2,5-di-tertiary butyl peroxyhexane, 2,5-dimethyl-2,5-di-tertiary butyl peroxyhexine, a,a-di-tertiary butyl peroxy isopropylbenzene, tertiary butyl peroxyketone, tertiary butyl peroxy benzoate and the like. When the foam of the present invention is used for a sole or sole member such as midsole, outersole and insole, it is preferable that a cross-linking agent is added.

Further, to the resin composition of the present invention, various additives such as cress-linking aids, heat stabilizers, weathering agents, lubricants, antistatic agents, fillers/pigments such as metal oxides (e.g. zinc oxide, titanium oxide, calcium oxide, magnesium oxide, silicon oxide), carbonates (e.g. magnesium carbonate, calcium carbonate) and fibrous materials (e.g. pulp), if necessary, and the like may be added, furthermore, resins/rubbers other than such as a high-pressure processed low density polyethylene, a high density polyethylene, polypropylene, a polyvinylacetate, and polybutene, may be compounded, if necessary.

The resin composition for press foaming can be obtained by kneading the ethylene-based copolymer and a foaming agent, if necessary, further other components with a mixing roll, a kneader, an extruder or the like at a temperature at which a foaming agent is not decomposed.

The pressure-foamed molded bodies can be obtained by a foaming process containing:

(1) filling the resin composition for press foaming into a mold with an injection machine such as an injection molding machine or the like;
(2) subjecting the filled composition to foaming under a pressurized state or a state under the pressure is kept, and a heated state; and
(3) cooling the composition to take off a foam from the mold.

Further, there is exemplified a method of charging the expandable composition in a mold, foaming the composition under a pressurized and heated condition with a pressing machine or the like, and cooling a foam to take off the foam from the mold.

Usually, the press foaming are usually carried out under conditions of a pressure of 50 to 300 kg/cm$^2$, a temperature of 30 to 200° C. and a time of 5 to 60 minutes.

Further, the above-described foam may be used after secondary compression. The secondary compression is usually carried out at a temperature of 130 to 200° C. under application of a load of 30 to 200 kg/cm$^2$ for 5 to 60 minutes.

From the foam of the present invention, a multi-layer laminate may be produced by laminating a foamed layer composed of a pressure-foam molding, with a layer composed of a resin other than the ethylene-based copolymer. The materials other than the ethylene-based copolymer includes, for example, polyvinyl chloride resins, styrene-based copolymer rubbers, olefin-based rubber materials (e.g. ethylene-based copolymer rubber materials, propylene-based copolymer rubbers), a natural leather materials, artificial leather materials, cloth materials. As these materials, at least one of the materials is used.

As producing method of the multi-layered laminates, there is provided, for example, a method of molding a foam by press foaming the resin composition of the present invention, and then laminating the foam and a molded body separately prepared from a non-ethylene-based resin material by heating or a chemical adhesive. As the chemical adhesive, known adhesives can be used. Among them, an urethane-type chemical adhesive and chloroprene-type chemical adhesive are preferable. Further, in the lamination with these adhesives, a primer may be previously coated.

The foam obtained by press foaming of the present invention is excellent in balance between fatigue resistance and tensile strength at break. Therefore, the foam of the present invention can be suitably used as, for example, a member of foot wear such as shoes and sandals in the form of single layer or multi layers. As the member of foot wear, midsoles, outersoles, insoles and the like are exemplified. Further, the foam of the present invention is used for construction materials such as a thermal insulator and cushioning material, or the like as well as the member of foot wear.

EXAMPLE

The invention will be explained by referring to Examples and Comparative Examples.

Physical properties in Examples and Comparative Examples were determined by the following methods:

[Physical Properties of Polymer]

(1) Melt Flow Rate (MFR, Unit: g/10 Minutes)

It was measure by the A-method under conditions of a temperature of 190° C. and a load of 21.18 N according to JIS K7210-1995.

(2) Density (Unit: Kg/m$^3$)

It was measured by the underwater replacement method described in JIS K7112-1980 after a sample had been annealed according to JIS K6760-1995.

(3) Activation Energy of Flow (Ea, Unit: kJ/mol)

It was determined as follows: measuring a melting complex viscosity-angular frequency curve with a viscoelasticity meter (Rheometrics Mechanical Spectrometer RMS-800, manufactured by Rheometrics) at 130° C., 150° C., 170° C., and 190° C., respectively with the conditions described below, and forming a master curve of melting complex viscosity-angular frequency at 190° C. from the obtained melting complex viscosity-angular frequency curves with using a calculation software which is Rhios V.4.4.4 manufactured by Rheometrics:

<Measurement Conditions>

Geometry: Parallel plate
Plate diameter: 25 mm
Plate clearance: 1.5 to 2 mm
Strain: 5%
Angular frequency: 0.1 to 100 rad/sec
Measurement atmosphere: Under nitrogen (4) Molecular Weight Distribution (Mw/Mn)

A molecular weight distribution (Mw/Mn) was determined by measuring a weight average molecular weight (Mw) and a number average molecular weight (Mn) by a gel permeation chromatography (GPC) under the conditions of (1) to (8) described below.

A baseline on a chromatogram was defined with a line connecting points belonged in two stably horizontal regions, one of which regions had a retention time sufficiently shorter before an elution peak of a sample emerging, and other of which regions had a retention time sufficiently longer after an elution peak of a solvent being observed:

(i) Apparatus: Waters 150C manufactured by Water Associates, Inc.
(ii) Separation column: TOSOH TSKgelGMH6-HT
(iii) Measurement temperature: 140° C.
(iv) Carrier: Orthodichlorobenzene
(v) Flow rate: 1.0 mL/minute
(vi) Injected volume: 500 μL
(vii) Detector: Differential refractometer
(viii) Standard substance for molecular weight: Standard polystyrene.

(5) The Number of Inflection Points of Melting Curve, Maximum Melting Point (Tm, Unit; ° C.)

A test piece was prepared by pressing an ethylene-a-olefin copolymer with a hot pressing device at 150° C. under a pressure of 10 MPa for 5 minutes, cooling down with a cool pressing device at 30° C. for 5 minutes to mold a sheet with about 100 μ-thick, and then cutting about 10 mg of a sample out from the sheet to be enclosed in a pan made of aluminum. The sample enclosed in the aluminum pan was subjected to measurement of a melting curve with a differential scanning calorimeter (the differential scanning calorimeter DSC-7 type manufactured by Perkin Elmer Co., Ltd.) according to a procedure of (1) preserving at 150° C. for 5 minutes, (2) cooling down from 150° C. to 20° C. at a rate of 5° C./minute, (3) again preserving at 20° C. for 2 minutes, (4) further heating up from 20° C. to 150° C. to obtain the curve from the step (4). According to the melting curve obtained, determined were a temperature at a melting peak having the highest peak height among the melting peaks observed in the range of from 25° C. to an end point of melting (the temperature at which the melting curve returned to a base line in the high temperature side) and the number of inflection points present in the range of from 25° C. to the end point of melting.

(6) Density of Foam (Unit: kg/m$^3$)

It was measured according to ASTM D297. When this value is smaller, lightness is more excellent.

(7) Hardness of Foam (Unit: None)

The surface of which the foam is contacted with an inner surface of a mold of the foam was measured using a C-method hardness meter according to ASTM D2240.

(8) Tensile Strength at Break of Foam (Unit: kg/cm)

It was measured according to ASTM-D642. Specifically, a foam was sliced at a thickness of 10 mm, then, punched in the form of No. 3 dumbbell to make a specimen. This specimen was pulled at a speed of 500 mm/minute, and the maximum load F (kg) in breaking of the specimen was divided by a thickness of the sample piece of 1 cm to obtain tear strength. When this value is larger, the foam is excellent in tensile strength at break.

(9) Permanent Compression Set of Foam (Unit: %)

It was measured by carrying out a test for permanent compression set at 50° C. for 6 hours under a condition of 50% compression according to JIS K6301-1995. When this value is smaller, a fatigue resistance is excellent.

Example 1

(1) Preparation of Co-Catalyst Support

Into a reactor equipped with a stirrer, purged with nitrogen were charged 0.36 kg of silica (Sylopol 948 manufactured by Devison, Ltd.; 50% volume average particle size=59 μm; pore volume=1.68 mL/g; specific surface area=313 $m^2/g$) heat-treated at 300° C. under a nitrogen flow and 3.5 L of toluene, then the resulting mixture was stirred. The mixture was cooled to 5° C., then, a mixed solution of 0.15 L of 1,1,1,3,3,3-hexamethyldisilazane and 0.2 L of toluene was added thereto dropwise over 30 minutes while keeping 5° C. After completion of the dropping, the mixture was stirred at 5° C. for 1 hour, then at 95° C. for 3 hours after heated to 95° C. and filtrated. Thus obtained solid was washed six times with each toluene of 2 L. Thereafter, 2 L of toluene was added to obtain a slurry, then, the mixture was allowed to stand still overnight.

Putting 0.27 L of a hexane solution of diethyl zinc (diethyl zinc concentration: 2 mol/L) into the slurry obtained above to obtain a mixture in the reactor, thereafter stirring the mixture obtained; and then cooling down to 5° C. Dropping a mixture of 0.05 kg of pentafluorophenol and 0.09 L of toluene into the reactor for 60 minutes with maintaining the temperature of the reactor at 5° C. After completion of the dropping, stirring the resultant mixture at 5° C. for 1 hour, heating up to 40° C., stirring at 40° C. for 1 hour; and then again cooling down to 5° C., thereafter dropping 7 g of $H_2O$ into the reactor for 1.5 hours with maintaining the temperature of the reactor at 5° C. After completion of the dropping, stirring the resultant mixture at 5° C. for 1.5 hours, heating up to 55° C., stirring at 55° C. for 2 hours; and then cooling down to a room temperature. Thereafter, putting 0.63 L of a hexane solution of diethyl zinc (diethyl zinc concentration: 2 moles/L) in the reactor; and then cooling the resultant mixture down to 5° C. Dropping a mixture of 94 g of 3,4,5-trifluorophenol and 0.2 liters of toluene into the reactor for 60 minutes with maintaining the temperature of the reactor at 5° C. After completion of the dropping, stirring the resultant mixture at 5° C. for 1 hour, heating up to 40° C., stirring at 40° C. for 1 hour; and then again cooling down to 5° C. Thereafter dropping 17 g of $H_2O$ into the reactor for 1.5 hours with maintaining the temperature of the reactor at 5° C. After completion of the dropping, stirring the resultant mixture at 5° C. for 1.5 hour, heating up to 40° C., stirring at 40° C. for 2 hours; and then further heating up to 80° C., and stirring at 80° C. for 2 hours. Thereafter, leaving the mixture in the reactor at rest to precipitate a solid component until an interface between a lower layer of solid component precipitated and an upper layer of slurry appearing, removing the upper slurry layer, and then removing a liquid component contained in the lower layer by filtration to collect a solid component, and then adding 3 liters of toluene to the solid component collected to obtain a slurry, and then stirring the slurry obtained at 95° C. for 2 hours. Thereafter, leaving the slurry described just above at rest to precipitate a solid component until an interface between a lower layer of solid component precipitated and an upper layer of slurry appearing, and then removing the upper slurry layer. Thereafter, providing the following procedure to the lower layer of solid component four cycles at 95° C. with 3 liters of toluene respectively and two cycles at a room temperature with 3 liters of hexane respectively; the procedure being adding the solvent, stirring, leaving at rest to precipitate a solid component until an interface between a lower layer of solid component precipitated and an upper layer of slurry appearing, and then removing the upper slurry layer. Thereafter, removing a liquid component contained in the lower layer by filtration; and then drying under a reduced pressure at a room temperature for 1 hour to obtain a solid component (hereinafter, referred to as a co-catalyst support (a)).

(2) Preparation of Prepolymerization Catalyst Component (1)

After charging 80 L of butane into an autoclave having an interior volume of 210 liters equipped with an agitator under a nitrogen substitution atmosphere, putting 101 mmol of racemi-ethylene-bis(1-indenyl)zirconium diphenoxide, and then heating the autoclave up to 50° C. to agitate for 2 hours. After decreasing the temperature of the autoclave down to 30° C. to stabilize its system, charging ethylene in an amount corresponding to a 0.03 MPa of the gas phase pressure in the autoclave, putting 0.7 kg of the co-catalyst support (a) mentioned above, and then putting 158 mmol of triisobutylaluminum to start polymerization. The prepolymerization was carried out for totally 4 hours while continuously charging ethylene at a rate of 0.7 kg/hour for 30 minutes, and then raising the polymerization temperature up to 50° C. as well as continuously charging ethylene at a rate of 3.5 kg/hour and hydrogen at a rate of 5.5 L (a volume in terms of the normal state)/hour, respectively. After completion of the polymerization, purging the residual ethylene, butane, and hydrogen gases and then a solid left was dried under vacuum to obtain a prepolymerization catalyst component (1) in which 15 g of ethylene was prepolymerized per 1 g of the co-catalyst support (a) mentioned above.

(3) Production of Ethylene-a-Olefin Copolymer

With using the prepolymerization catalyst component (1) obtained above, ethylene and 1-hexene were copolymerized with a continuous fluidized bed gas-phase polymerization apparatus to obtain a polymer powder. The polymerization was conducted under conditions of a polymerization temperature of 75° C., a polymerization pressure of 2 MPa, a molar ratio of hydrogen to ethylene of 1.6%, a molar ratio of 1-hexene to the sum of ethylene and 1-hexene of 1.5% with continuously charging ethylene, 1-hexene, and hydrogen gases to keep the above gas molar ratios during the polymerization. The prepolymerization catalyst component mentioned above and triisobutylaluminum were also continuously supplied to maintain a total amount of powder in the fluidized bed to be 80 kg; and the average polymerization time was 4 hours. The polymer powder obtained pelletized with an extruder (LCM50 manufactured by KOBE STEEL, LTD.) under conditions of a feed rate of 50 kg/hr, a screw rotating speed of 450 rpm, a gate opening of 50%, a suction pressure of 0.1 MPa, and a resin temperature of 200 to 230° C., to obtain an ethylene-1-hexene copolymer (hereinafter, referred to as "PE(1)"). The results of evaluating physical properties of the ethylene-1-hexene copolymer obtained are shown in Table 1.

(4) Pressure Foaming

PE(1) of 100 parts by weight, heavy calcium carbonate of 50 parts by weight, stearic acid of 0.5 parts by weight, zinc oxide of 1.5 parts by weight, azodicarbon amide of 4.5 parts by weight as a thermal decomposition type foaming agent and dicumylperoxide as a crosslinking agent of 1.0 part by weight were kneaded with a roll kneader at a roll temperature of 120° C. for a kneading time of 5 minutes to obtain a resin composition. The composition was filled in a mold of 15 cm×15 cm×1.0 cm in inner size, then pressure-foamed at a temperature of 160° C. for 10 minutes under a pressure of 150 $kg/cm^2$ to obtain a pressure-foamed molding. Evaluation results of the molding obtained are shown in Table 1.

Example 2

(1) Preparation of Prepolymerization Catalyst Component (2)

After charging 80 L of butane into an autoclave having an interior volume of 210 liters equipped with an agitator under a nitrogen substitution atmosphere, putting 109 mmol of racemi-ethylenebis(1-indenyl)zirconium diphenoxide, and then heating the autoclave up to 50° C. to agitate for 2 hours. After decreasing the temperature of the autoclave down to 30° C. to stabilize its system, charging ethylene in an amount corresponding to a 0.03 MPa of the gas phase pressure in the autoclave, putting 0.7 kg of the co-catalyst support (a) mentioned above, and then putting 158 mmol of triisobutylaluminum to start polymerization. The prepolymerization was carried out for totally 4 hours while continuously charging ethylene at a rate of 0.7 kg/hour for 30 minutes, and then raising the polymerization temperature up to 50° C. as well as continuously charging ethylene at a rate of 3.5 kg/hour and hydrogen at a rate of 10.2 L (a volume in terms of the normal state)/hour, respectively. After completion of the polymerization, purging the residual ethylene, butane, and hydrogen gases and then a solid left was dried under vacuum to obtain a prepolymerization catalyst component (2) in which 15 g of ethylene was prepolymerized per 1 g of the co-catalyst support (a) mentioned above.

(2) Production of Ethylene-a-Olefin Copolymer

With the prepolymerization catalyst component (2) obtained above, ethylene and 1-hexene were copolymerized with a continuous fluidized bed gas-phase polymerization apparatus to obtain a polymer powder. The polymerization was carried out under conditions of a polymerization temperature of 80° C., a polymerization pressure of 2 MPa, a molar ratio of hydrogen to ethylene of 0.9%, a molar ratio of 1-hexene to the sum of ethylene and 1-hexene of 1.4% with continuously charging ethylene, 1-hexene, and hydrogen gases to keep the above gas molar ratios during the polymerization. The prepolymerization catalyst component mentioned above and triisobutylaluminum were also continuously supplied to maintain a total amount of powder in the fluidized bed to be 80 kg; and the average polymerization time was 4 hours. The polymer powder obtained was pelletized with an extruder (LCM50 manufactured by KOBE STEEL, LTD.) under conditions of a feed rate of 50 kg/hr, a screw rotating speed of 450 rpm, a gate opening of 50%, a suction pressure of 0.1 MPa, and a resin temperature of 200 to 230° C., to obtain an ethylene-1-hexene copolymer (hereinafter, referred to as "PE(2)"). The results of evaluating physical properties of the ethylene-1-hexene copolymer obtained are shown in Table 1.

(3) Pressure Foaming

PE(2) of 100 parts by weight, heavy calcium carbonate of 50 parts by weight, stearic acid of 0.5 parts by weight, zinc oxide of 1.5 parts by weight, azodicarbon amide of 5.0 parts by weight as a thermal decomposition type foaming agent and dicumylperoxide as a crosslinking agent of 1.0 part by weight were kneaded with a roll kneader at a roll temperature of 120% for a kneading time of 5 minutes to obtain a resin composition. The composition was filled in a mold of 15 cm×15 cm×1.0 cm in inner size, then pressure-foamed at a temperature of 160% for 10 minutes under a pressure of 150 kg/cm$^2$ to obtain a pressure-foamed molding. Evaluation results of the molding obtained are shown in Table 1.

Example 3

(1) Production of Ethylene-a-Olefin Copolymer

With the prepolymerization catalyst component (2) obtained in Example 2 (1), ethylene and 1-hexene were copolymerized using a continuous fluidized bed gas-phase polymerization apparatus to obtain a polymer powder. The polymerization was carried out under conditions of a polymerization temperature of 80° C., a polymerization pressure of 2 MPa, a molar ratio of hydrogen to ethylene of 0.4%, a molar ratio of 1-hexene to the sum of ethylene and 1-hexene of 1.6% with continuously charging ethylene, 1-hexene, and hydrogen gases to keep the above gas molar ratios during the polymerization. The prepolymerization catalyst component mentioned above and triisobutylaluminum were also continuously supplied to maintain a total amount of powder in the fluidized bed to be 80 kg; and the average polymerization time was 4 hours. The polymer powder obtained was pelletized with an extruder (LCM50 manufactured by KOBE STEEL, LTD.) under conditions of a feed rate of 50 kg/hr, a screw rotating speed of 450 rpm, a gate opening of 50%, a suction pressure of 0.1 MPa, and a resin temperature of 200 to 230° C., to obtain an ethylene-1-hexene copolymer (hereinafter, referred to as "PE(3)"). The results of evaluating physical properties of the ethylene-1-hexene copolymer obtained are shown in Table 1.

(2) Pressure Foaming

PE(3) of 40 parts by weight, ethylene-vinyl acetate copolymer (manufactured by Sumitomo Chemical company, Limited, trade name: Sumitate KA-31 [MFR=7 g/10 minutes, density=940 kg/m$^3$, Vinyl acetate unit amount=28% by weight], hereinafter, referred to as "EVA(1)) of 60 parts by weight, heavy calcium carbonate of 50 parts by weight, stearic acid of 0.5 parts by weight, zinc oxide of 1.5 parts by weight, azodicarbon amide of 3.6 parts by weight as a thermal decomposition type foaming agent and dicumylperoxide as a crosslinking agent of 1.0 part by weight were kneaded with a roll kneader at a roll temperature of 120° C. for a kneading time of 5 minutes to obtain a resin composition. The composition was filled in a mold of 15 cm×15 cm×1.0 cm in inner size, then pressure-foamed at a temperature of 160° C. for 10 minutes under a pressure of 150 kg/cm$^2$ to obtain a foam. Evaluation results of the molding obtained were shown in Table 1.

Comparative Example 1

(1) Preparation of Prepolymerization Catalyst Component (3)

After charging 0.53 kg of the co-catalyst support (a) obtained in Example 1 (1), 3 L (in terms of normal state) of hydrogen and 80 L of butane into an autoclave having an interior volume of 210 L equipped with an agitator under a nitrogen substitution atmosphere, the autoclave was heated to 30° C. Further, ethylene in an amount corresponding to a 0.03 MPa of the gas phase pressure in the autoclave, was charged. After the reaction system was stabilized, 159 mmol of triisobutylaluminum and 53 mmol of racemi-ethylenebis(1-indenyl)zirconium diphenoxide were charged to start polymerization.

The prepolymerization was carried out for totally 4 hours while continuously charging ethylene at a rate of 0.3 kg/hour and hydrogen at a rate of 2.8 L (in terms of normal state)/hour for 30 minutes together with raising the temperature of the autoclave to 31° C., and then raising the temperature up to 51° C. as well as continuously charging ethylene at a rate of 2.8 kg/hour and hydrogen at a rate of 22 liters (a volume in terms of the normal state)/hour, respectively. After completion of the polymerization, purging the residual ethylene, butane, and hydrogen gases and then a solid left was dried under vacuum to obtain a prepolymerization catalyst component (3)

in which 14 g of ethylene was prepolymerized per 1 g of the co-catalyst support (a) mentioned above.

(2) Production of Ethylene-a-Olefin Copolymer

With using the prepolymerization catalyst component (3) obtained above, ethylene and 1-hexene were copolymerized with a continuous fluidized bed gas-phase polymerization apparatus to obtain a polymer powder. The polymerization was conducted under conditions of a polymerization temperature of 75° C., a polymerization pressure of 2 MPa, a molar ratio of hydrogen to ethylene of 1.0%, a molar ratio of 1-hexene to the sum of ethylene and 1-hexene of 1.2% with continuously charging ethylene, 1-hexene, and hydrogen gases to keep the above gas molar ratios during the polymerization. The prepolymerization catalyst component mentioned above and triisobutylaluminum were also continuously supplied to maintain a total amount of powder in the fluidized bed to be 80 kg; and the average polymerization time was 4 hours. The polymer powder obtained, pelletized with an extruder (LCM50 manufactured by KOBE STEEL, LTD.) under conditions of a feed rate of 50 kg/hr, a screw rotating speed of 450 rpm, a gate opening of 50%, a suction pressure of 0.1 MPa, and a resin temperature of 200 to 230° C., to obtain an ethylene-1-hexene copolymer (hereinafter, referred to as "PE(3)"). The results of evaluating physical properties of the ethylene-1-hexene copolymer obtained are shown in Table 2.

(3) Pressure Foaming

PE(3) of 100 parts by weight, heavy calcium carbonate of 50 parts by weight, stearic acid of 0.5 parts by weight, zinc oxide of 1.5 parts by weight, azodicarbon amide of 4.5 parts by weight as a thermal decomposition type foaming agent and dicumylperoxide as a crosslinking agent of 1.0 part by weight were kneaded with a roll kneader at a roll temperature of 120° C. for a kneading time of 5 minutes to obtain a resin composition. The composition was filled in a mold of 15 cm×15 cm×1.0 cm in inner size, then pressure-foamed at a temperature of 160° C. for 10 minutes under a pressure of 150 kg/cm$^2$ to obtain a pressure-foamed molding. Evaluation results of the molding obtained were shown in Table 2.

Preparation of Prepolymerization Catalyst Component (3)

Comparative Example 2

(1) Pressure-Foam Molding

Ethylene-vinyl acetate copolymer (manufactured by The Polyolefin company, Limited, trade name: Cosmothene H2181 [MFR=2 g/10 minutes, density=940 kg/m$^3$, Vinyl acetate unit amount=18% by weight], hereinafter, referred to as "EVA(2)) of 100 parts by weight, heavy calcium carbonate of 50 parts by weight, stearic acid of 0.5 parts by weight, zinc oxide of 1.5 parts by weight, azodicarbon amide of 2.5 parts by weight as a thermal decomposition type foaming agent and dicumylperoxide as a crosslinking agent of 0.7 parts by weight were kneaded with a roll kneader at a roll temperature of 120° C. for a kneading time of 5 minutes to obtain a resin composition. The composition was filled in a mold of 15 cm×15 cm×1.0 cm in inner size, then pressure-foamed at a temperature of 160° C. for 10 minutes under a pressure of 150 kg/cm$^2$ to obtain a pressure-foamed molding. Evaluation results of the molding obtained were shown in Table 2.

TABLE 1

| | | Example 1 | Example 2 | Example 3 |
|---|---|---|---|---|
| Component A | | PE(1) | PE(2) | PE(3) |
| Melt flow rate (MFR) | g/10 min. | 0.49 | 0.08 | 0.12 |
| Density | Kg/m$^3$ | 913 | 914 | 911 |
| Added amount | Part by weight | 100 | 100 | 40 |
| Number of inflection point on melting curve | — | 3 | 3 | 3 |
| Maximum melting point (Tm) | ° C. | 102.6 | 104.1 | 101.3 |
| Left side of Formula (1) | | 101.5 | 102.7 | 100.1 |
| Right side of Formula (1) | | 106.6 | 105.7 | 105.0 |
| Activation energy of flow (Ea) | kJ/mol | 72.8 | 73.5 | 67.4 |
| Molecular weight distribution (Mw/Mn) | — | 9.6 | 9.2 | 7.9 |
| Component B | | | | EVA(1) |
| Melt flow rate (MFR) | g/10 min. | — | — | 7 |
| Density | Kg/m$^3$ | — | — | 940 |
| Added amount | Part by weight | — | — | 60 |
| Foamed molded body | | | | |
| Density | Kg/m$^3$ | 138 | 139 | 179 |
| Hardness | | 48 | 52 | 49 |
| Tensile strength at break | Kg/cm | 15.2 | 17.2 | 15.4 |
| Compression Set | % | 56 | 49 | 44 |

TABLE 2

| | | Comparative Example 1 | Comparative Example 2 |
|---|---|---|---|
| Resin | | PE(3) | |
| Physical properties of polymer | Unit | | — |
| Melt flow rate (MFR) | g/10 min. | 0.50 | — |
| Density | Kg/m$^3$ | 911.9 | — |
| Added amount | Part by weight | 100 | — |
| Number of inflection point on melting curve | — | 5 | — |
| Maximum melting point (Tm) | ° C. | 100 | — |
| Left side of Formula (1) | | 100.7 | — |
| Right side of Formula (1) | | 105.7 | — |
| Activation energy of flow (Ea) | kJ/mol | 72.9 | — |
| Molecular weight distribution (Mw/Mn) | — | 8.6 | — |
| Component B | | | EVA(2) |
| Melt flow rate (MFR) | g/10 min. | — | 2.0 |
| Density | Kg/m$^3$ | — | 940 |
| Added amount | Part by weight | — | 100 |
| Foamed molded body | | | |
| Density | Kg/m$^3$ | 139 | 231 |
| Hardness | — | 54 | 52 |
| Tensile strength at break | Kg/cm | 15.0 | 12.2 |
| Compression Set | % | 61 | 48 |

The invention claimed is:

1. A resin composition for pressure-foam molding, which comprises an ethylene-based copolymer and a foaming agent, wherein the ethylene-based copolymer has monomer units derived from ethylene and monomer units derived from an α-olefin having 3 to 20 carbon atoms, has a melt flow rate of 0.01 to 0.7 g/10 minutes, a molecular weight distribution of 5 or more determined by a gel permeation chromatography, an activation energy of flow of 40 kJ/mol or more, and inflection points of 3 or less on a melting curve within temperature range from 25° C. to the end point of melting obtained by a differential scanning calorimetry.

2. The resin composition according to claim 1, further comprises an ethylene-unsaturated ester-based copolymer having monomer units derived from ethylene and monomer units derived from an unsaturated ester selected from the group consisting of carboxylic acid vinyl esters and unsaturated carboxylic acid alkyl esters copolymer, wherein contents of the ethylene-based copolymer and the ethylene-unsaturated ester-based copolymer are respectively 99 to 30% by weight and 1 to 70% by weight based on 100% by weight of the total of the copolymers.

3. A foam obtained by subjecting the resin composition of claim 1 or 2 to press foaming.

4. A foam obtained by subjecting the resin composition of claim 1 or 2 to press foaming followed by secondary compression.

5. A process for producing a foam, which comprises subjecting the resin composition of claim 1 or 2 to press foaming.

6. A footwear member comprising a layer of the foam of claim 3.

7. A footwear comprising the footwear member of claim 6.

8. A footwear member comprising a layer of the foam of claim 4.

9. A footwear comprising the footwear member of claim 8.

* * * * *